United States Patent [19]

Baker et al.

[11] 4,316,504

[45] Feb. 23, 1982

[54] CHECK/RELIEF VALVE FOR AN INFLATABLE PACKER SYSTEM

[75] Inventors: Randy S. Baker, Long Beach; Gerald C. Eckmann, La Puente, both of Calif.

[73] Assignee: BJ-Hughes Inc., Long Beach, Calif.

[21] Appl. No.: 120,585

[22] Filed: Feb. 11, 1980

[51] Int. Cl.[3] ..... E21B 33/127; F16K 15/08

[52] U.S. Cl. ..... 166/53; 166/325; 137/116; 137/540

[58] Field of Search ..... 137/116, 117, 540; 166/321, 325, 290, 53

[56] References Cited

U.S. PATENT DOCUMENTS

| | | | |
|---|---|---|---|
| 2,203,577 | 6/1940 | O'Neill et al. | 166/325 X |
| 2,610,028 | 9/1952 | Smith | 166/325 |
| 2,875,774 | 3/1959 | Banker | 137/116 |
| 3,075,589 | 1/1963 | Grable et al. | 166/325 X |
| 3,193,016 | 7/1965 | Knox | 166/325 X |
| 3,439,740 | 4/1969 | Conover | 166/290 X |
| 4,240,255 | 12/1980 | Benilan | 137/116 X |

*Primary Examiner*—William R. Cline

*Attorney, Agent, or Firm*—Robert A. Felsman

[57] ABSTRACT

A check/relief valve intended for use in an inflatable packer system. The valve comprises a hollow cylindrical longitudinally extending inner member surrounded by a spring loaded relief piston and a spring loaded check valve poppet, all surrounded by a hollow longitudinally extending outer member.

4 Claims, 2 Drawing Figures

CHECK/RELIEF VALVE FOR AN INFLATABLE PACKER SYSTEM

CROSS-REFERENCE TO RELATED APPLICATION

U.S. patent application Ser. No. 120,418 filed Feb. 11, 1980, for an Inflatable Packer System by Felix Kuus.

BACKGROUND OF THE INVENTION

1. Field of the Invention

A check/relief valve intended for use in an inflatable packer system utilizes a positive displacement pump to inflate the packer elements. The positive displacement pump takes in abrasive drilling mud and pumps pressurized mud to one or more packer elements to inflate them and thereby seal off a zone in a well preparatory to testing.

Various problems may occur in such a system, among which are: a pressure loss in the system upstream of the packer elements; rupture of the packer elements due to overinflation; and pump damage due to overpressure.

2. Prior Art

An inflatable packer system in use today in the oil fields is described in U.S. Pat. No. 3,439,740 to G. E. Conover. The Conover system incorporates a positive displacement piston pump which takes in abrasive drilling mud and pumps pressurized mud to packer elements to inflate them. The pump has four pistons and associated inlets and outlets. There is a suction check valve in each inlet and a discharge check valve in each outlet of the pump.

The inlet check valves are constructed so that, when pump pressure exceeds the static pressure in the well bore by a predetermined amount, the suction check valves unseat so that each of the pistons will discharge fluid through a respective suction check valve rather than out through a respective discharge valve.

The discharge valves are constructed so that fluid may be pumped to the packer elements. In addition, there is a master check valve downstream from the discharge valves which is closed in the absence of pump pressure.

However, in a system such as Conover's, the suction/discharge valves have a short service life and require frequent maintenance due to the extreme service conditions involved in pumping abrasive fluid at extremely high pressures. In addition, if a valve fails, the pump section must be replaced due to the incorporation of the valves in the pump.

SUMMARY OF THE INVENTION

The present invention is intended for use in the inflatable packer system of copending U.S. patent application Ser. No. 120,418, filed Feb. 11, 1980, by Felix Kuus. The invention relates to a check/relief valve which may be a separate module, preferably positioned between a positive displacement pump and one or more packer elements in the system.

The preferred embodiment of the valve may incorporate a longitudinally extending cylindrical inner member, surrounded by a spring loaded relief piston and a spring loaded check valve poppet. In turn, these may be surrounded by a longitudinally extending outer member.

When pump pressure builds up beyond a predetermined pressure differential, inflation fluid acting on the relief piston of this embodiment moves the piston downwardly until a relief port in the piston passes under a seal between the piston and the outer member. At that time, inflation fluid will be vented to the well annulus through a relief vent in the wall of the outer member.

In the check valve portion of this preferred embodiment, as inflation fluid pressure builds up, the check valve poppet will be opened to allow inflation fluid to flow to the packer element(s). Should inflation fluid pressure fall or be lost upstream from the check valve, the check valve poppet will move to the closed position to prevent packer element deflation.

DETAILED DESCRIPTION

Check/Relief Valve 106

Figure 1A:
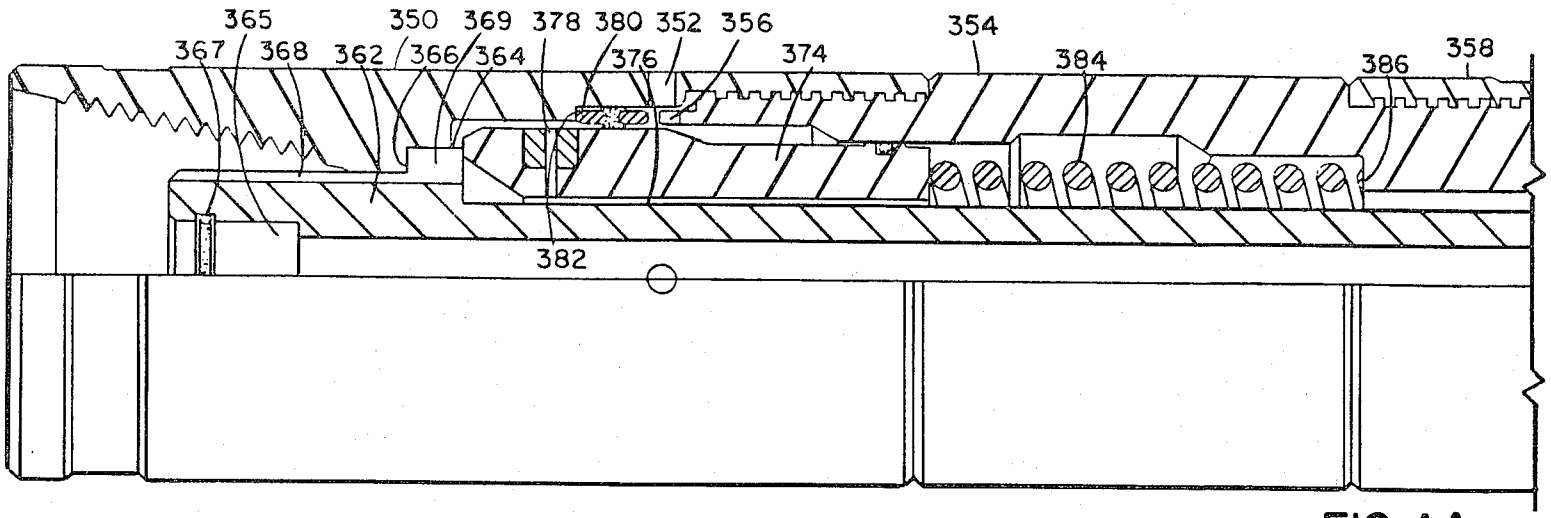
FIGS. 1A and 1B illustrate the check/relief valve in partial cross-section.
Figure 1B:
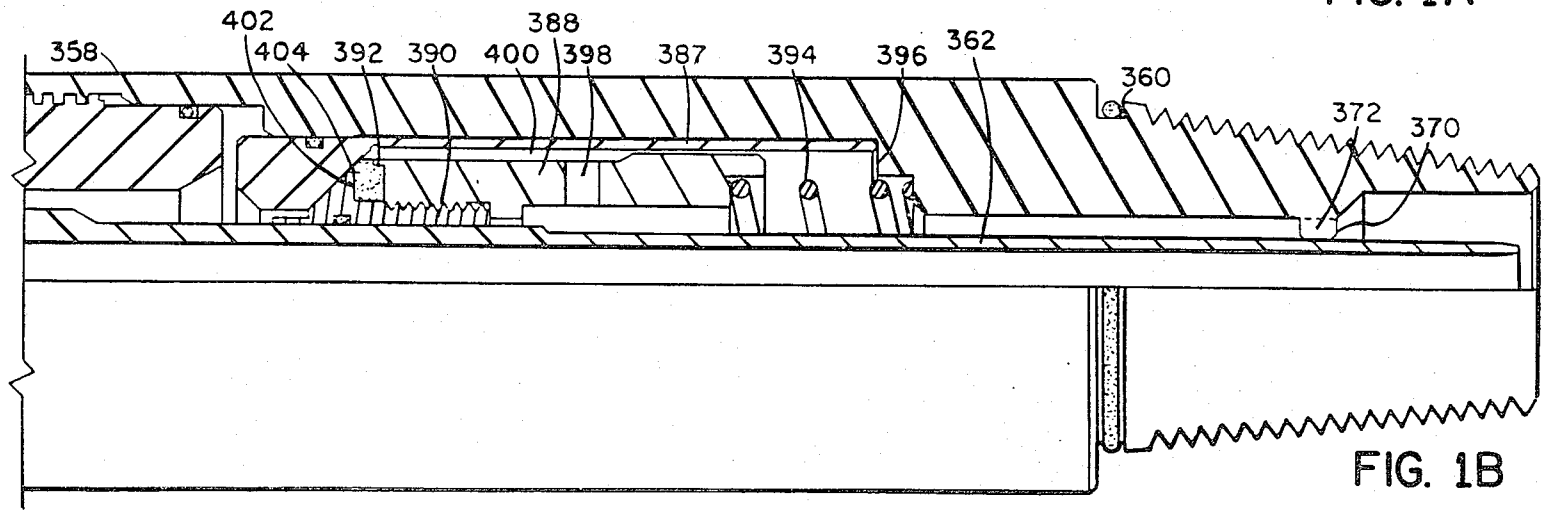

A presently preferred embodiment for a check/relief valve 106 is shown in partial cross-section, in FIGS. 1A and 1B.

A cylindrical top sub 350, internally threaded near its upper end, may have a relief vent 352 through the wall near the bottom end thereof. The top sub 350 may be internally threaded near its lower end and a cylindrical middle sub 354, externally threaded near its upper end, attached thereto. The uppermost end of the middle sub 354 underlies the relief vent 352 and may be relieved as at 356 in that area.

The lower end of middle sub 354 may be externally threaded and the upper, internally threaded end of check valve body 358 may be attached thereto. The lower end of the check valve body 358 may be tapered and externally threaded and thus adapted to fit into the next lower module when the testing tool is made up. Top sub 350, middle sub 354, and check valve body 358 together comprise a longitudinally extending cylindrical outer member located in the drill stem intermediate of the pump and packers. A conventional O-ring may surround the lower end of the check valve body 358 near the juncture of the threaded portion and the main body, as at 360, to provide a seal between the check valve body 358 and the next module when the testing tool is used.

A cylindrical inner member or stinger 362 may be positioned internally of and extend nearly the length of top sub 350, entirely through middle sub 354, and nearly the length of check valve body 358. The stinger 362 may be centered within the top sub 350 by means such as a radially extending collar 364, the upper face of which bears against a shoulder 366 formed on the internal diameter of top sub 350.

The upper end of the stinger 362 and collar 364 are channeled as at 368 and 369, respectively, to provide for inflation fluid flow. The interior of the upper end of stinger 362 may be enlarged as at 365 and a conventional O-ring carried in groove 367.

The lower end of stinger 362 may be centered within check valve body 358 by means such as a spider 370 on the internal diameter of the check valve body 358. The spider 370 may be grooved, as at 372, to also allow flow of inflation fluid.

A cylindrical relief valve piston 374 is an annular ring preferably positioned between top sub 350 and stinger 362. The upper end of the relief valve piston 374 bears against the lower face of collar 364 on stinger 362. The relief valve piston 374 is internally grooved as at 376 to provide a fluid passageway between the external diameter of stinger 362 and the relief valve piston 374. A relief port 378 extends through the wall of relief valve piston 374 in fluid communication with grooved portion 376. The lower end of piston 374 preferably underlies the upper end of middle sub 354 and a conventional O-ring carried by the relief valve piston 374 may provide a seal therebetween.

A valve seal 380 may extend around the circumference of relief valve piston 374 between relief vent 352 and relief port 378. The valve seal 380 is held in position between the upper end of middle sub 354 and a downwardly facing shoulder 382 on the internal diameter of top sub 350.

The upper end of relief valve piston 374 may be held against the lower face of shoulder 366 by means such as a relief valve spring 384 which surrounds stinger 362. The upper end of relief valve spring 384 may abut the lower end of relief valve piston 374, while the lower end of the spring 384 may abut an upwardly facing internal shoulder 386 on middle sub 354.

A check valve assembly, preferably comprising a check valve seat 387, check valve poppet 388, check valve nut 390, check valve seal 392, and check valve spring 394, may be positioned internally of check valve body 358 and around stinger 362. The outer diameter of the upper end of check valve seat 387 bears against the inner diameter of check valve body 358 and a conventional O-ring carried by check valve seat 387 may provide a seal therebetween. The lower end of check valve seat 387 may bear against an upwardly facing shoulder 396 on the interior diameter of check valve body 358.

Check valve poppet 388 may be positioned within check valve seat 387 and be internally threaded at the upper end thereof. The wall of check valve poppet 388 may be ported, as at 398, to allow fluid flow between a space 400—formed by the radial difference between the interior diameter of check valve seat 387 and the outer diameter of check valve poppet 388—and the interior of check valve poppet 388.

The check valve nut 390 may be externally threaded near its lower end and threaded into the upper end of check valve poppet 388. The internal diameter of check valve nut 390 preferably rides on the external diameter of stinger 362 and a conventional O-ring carried by check valve nut 390 provides a seal therebetween.

Check valve seal 392 may thus be held in position between the upper end of check valve poppet 388 and a downwardly facing shoulder 402 formed on the external diameter of check valve nut 390. The upper, tapered face of check valve seal 392 thus bears against a matching, tapered face 404 on the internal diameter of check valve seat 387.

Operation of Check/Relief Valve 106

When the entire tool of this preferred embodiment is made up, a pump or other subassembly may be threaded into top sub 350 of check/relief valve 106. A reduced portion of a stinger in the pump may fit within the enlarged diameter 365 at the upper end of stinger 362.

A fluid passageway of the pump may then be in fluid communication with channels 368 and 369 in check-/relief valve 106. During inflation, inflation fluid flows through a fluid passageway comprising 368, 369, 376, and the space partially occupied by relief valve spring 384 until it abuts the check valve seal 392. Due to the pressure differential across the check valve seal 392, check valve poppet 388 pops open against check valve spring 394 and the inflation fluid continues flowing through a fluid passageway comprising 400, 398, and 372.

Should inflation fluid pressure be reduced or lost above check valve seal 392, check valve spring 394 forces check valve poppet 388 upwardly, seating check valve seal 392 against sealing surface 404. Thus, deflation of partially or fully inflated packer elements would be prevented.

The relief valve portion of the check/relief valve 106 prevents packer element overinflation by venting inflation fluid to the well annulus when a predetermined pressure differential between pump pressure and well annulus pressure is reached. The force required to compress relief valve spring 384 determines the pressure differential and can be chosen dependent on a required or desired operating condition.

When pump pressure builds up beyond the predetermined pressure differential, inflation fluid acting on the upper face of relief valve piston 374 moves relief valve piston 374 downwardly. When relief port 378 passes under valve seal 380, inflation fluid is vented to the well annulus through relief vent 352.

As will now be realized by those skilled in the art, a tool which utilizes the present invention produces the ability to test a well bore in a very simple operation requiring a minimum of time and skill. A wide variety of tools employing the invention defined by the following claims can now be envisioned, many of which may not even bear strong physical and relational resemblance to the presently preferred embodiment described and depicted here.

We claim:

1. A relief valve adapted for use in an inflatable packer system of the type having a positive displacement pump located upstream in the system and at least one packer element located downstream in the system below the pump, comprising:

a longitudinally extending cylindrical outer member located intermediate said pump and said packer elements;

vent means through the wall of said outer member;

a cylindrical inner member spaced apart from said outer member, thereby providing an inflation fluid passageway between said inner and outer cylindrical members said inner member being positioned in a fixed manner with respect to said cylindrical outer member;

a ring-shaped relief piston surrounding said cylindrical inner member in said inflation fluid passageway, said ring-shaped relief piston having a grooved inner wall providing a fluid passageway for fluid pumped between said piston and said inner cylindrical member and said piston having a port passing between said groove in said inner wall and the outer wall of said piston, said port providing a passageway for fluid pumped through said piston to said vent means;

an annular valve seal extending circumferentially about said relief piston between said piston outer wall and said cylindrical outer member; and said relief piston being adapted to move longitudinally between an upward non-vented position with said piston port located above said valve seal and a downward vented position with said piston port located below said valve seal and aligned with said vent means in said cylindrical outer member to vent inflation fluid to the exterior of the valve when inflation fluid pressure exceeds the pressure externally of said valve by a predetermined amount.

2. The relief valve of claim 1, wherein said relief piston is spring biased upwardly to the non-vented position.

3. A check/relief valve adapted for use in an inflatable packer system of the type having a positive displacement pump located upstream in the system and at least one packer element located downstream in the system below the pump, comprising:

a longitudinally extending cylindrical outer member located intermediate said pump and said packer elements;

vent means through the wall of said outer member;

a cylindrical inner member spaced apart from said outer member, thereby providing an inflation fluid passageway between said inner and outer cylindrical members said inner member being positioned in a fixed manner with respect to said cylindrical outer member;

a ring-shaped relief piston surrounding said cylindrical inner member in said inflation fluid passageway, said ring-shaped relief piston having a grooved inner wall providing a fluid passageway for fluid pumped between said piston and said inner cylindrical member and said piston having a port passing between said groove in said inner wall and the outer wall of said piston, said port providing a passageway for fluid pumped through said piston to said vent means;

an annular valve seal extending circumferentially about said relief piston between said piston outer wall and said cylindrical outer member; and said relief piston being adapted to move longitudinally between an upward non-vented position with said piston port located above said valve seal and a downward vented position with said piston port located below said valve seal and aligned with said vent means in said cylindrical outer member to vent inflation fluid to the exterior of the valve when inflation fluid pressure exceeds the pressure externally of said valve by a predetermined amount;

a ring-shaped check valve poppet positioned between said inner and outer cylindrical members in said inflation fluid passageway, the external diameter of said poppet being selected to provide an outer fluid passageway for fluid pumped between said poppet and said cylindrical outer member, and said poppet having a port passing between said outer passageway and an internal fluid passageway formed between the internal diameter of said poppet and said cylindrical inner member;

an annular check valve seat located between said cylindrical inner and outer members, said valve seat being spaced apart from said cylindrical inner member to provide a seat flow passage therebetween; and said check valve poppet being adapted to move longitudinally between an upward position in contact with said check valve seat to close off said seat flow passage when inflation fluid is lost, and a downward open position.

4. The check/relief valve of claim 3, wherein said check poppet means is spring biased upwardly to said inflation fluid passageway closed position.

* * * * *